US005628408A

United States Patent [19]

Planke et al.

[11] Patent Number: 5,628,408

[45] Date of Patent: May 13, 1997

[54] DEVICE FOR HANDLING EMPTY BEVERAGE CONTAINERS

[75] Inventors: Tore Planke; Tor Sjøwall, both of Oslo; Asbjørn Bendiksen, Asker, all of Norway

[73] Assignee: Tomra Systems A/S, Asker, Norway

[21] Appl. No.: 446,014

[22] Filed: May 19, 1995

[51] Int. Cl.[6] ..... B07C 5/00

[52] U.S. Cl. ..... 209/522; 209/525; 209/701; 209/583; 198/360

[58] Field of Search ..... 209/524, 523, 209/525, 583, 577, 701, 917; 364/478; 198/359, 360, 368, 370.01, 395

[56] References Cited

U.S. PATENT DOCUMENTS

| | | | |
|---|---|---|---|
| 2,717,086 | 9/1955 | Bush | 198/359 X |
| 3,411,622 | 11/1968 | Dickie | 198/360 X |
| 3,902,587 | 9/1975 | Checcucci | 198/725 X |
| 3,955,179 | 5/1976 | Planke | 209/525 X |
| 4,228,886 | 10/1980 | Moran | 198/395 |
| 4,549,272 | 10/1985 | Hagan et al. | 209/525 X |
| 4,593,190 | 6/1986 | Kawasaki et al. | 209/522 X |
| 5,078,258 | 1/1992 | van der Schoot | 209/701 X |
| 5,190,162 | 3/1993 | Hartlepp . | |
| 5,311,999 | 5/1994 | Malow et al. | 209/583 |
| 5,314,072 | 5/1994 | Frankel et al. . | |
| 5,322,152 | 6/1994 | Tommila et al. | 209/525 X |
| 5,497,887 | 3/1996 | Hiebert | 209/701 X |

FOREIGN PATENT DOCUMENTS

| | | | |
|---|---|---|---|
| 1188349 | 9/1959 | France | 198/837 |
| 2450127 | 9/1980 | France . | |
| 2522546 | 9/1983 | France | 209/525 |
| 9205523 | 4/1992 | WIPO . | |

*Primary Examiner*—Frank E. Werner
*Attorney, Agent, or Firm*—Rodman & Rodman

[57] ABSTRACT

A device for handling empty beverage containers, comprising a stationary, longitudinally extending, supporting path having a first end and a second end, along which path the containers are caused to move, by means of pushing devices, said pushing devices including a plurality of interlinked, parallel, spaced apart members positioned transversely of the path and having drive devices for moving said members along the path like an endless belt, said supporting path at least over part of its length forming an angle with the horizontal and having container bottom supporting devices along at least part of its lower (longitudinal edge, and exit devices for discharging a specific container from the supporting path at a specific, related location along the said path.

7 Claims, 5 Drawing Sheets

DEVICE FOR HANDLING EMPTY BEVERAGE CONTAINERS

The present invention relates to a device for handling empty beverage containers.

It has previously been known to move empty beverage containers to particular operating stations by means of a conveyor such as e.g. disclosed by U.S. Pat. No. 5,248,102.

Although an apparatus as described in said U.S. patent is fully operable for the tasks it is to solve, including the desire to have a compact, space-saving device, its structure is complex, and it has therefore been a desire to provide a novel device which is mechanically simpler, yet is able to perform the same or similar tasks possible with the device of U.S. Pat. No. 5,248,102. The present invention therefore also aims at a device which is relatively space saving, although not necessarily being as compact as the device of said U.S. Pat. No. 5,248,102.

According to the present invention, there is provided a device for handling empty beverage containers, comprising

- a stationary, longitudinally extending, supporting path having a first end and a second end, along which path said containers are caused to move, by means of pushing means,
- said pushing means including a plurality of interlinked, parallel, spaced apart members positioned transversely of said path and having drive means for moving said members along said path like an endless belt,
- said supporting path at least over part of its length forming an angle with the horizontal and having container bottom supporting means along at least part of its lower longitudinal edge, and
- exit means for discharging a specific container from said supporting path at a specific, related location along said conveyor means.

Thus, the present device provides a total control of a container position along said path due to the instantaneous position of a pushing means adjacent the container always being known.

The present device has one or more exits, and the device may also have any desired number of detecting zones.

According to the invention, said exit means may be located in said supporting path or said bottom supporting means.

Suitably, said supporting path has an inclination with the horizontal which varies along the longitudinal distance of said path.

Further, said supporting path may have an angle with the horizontal which is smaller at a first section of said path than at a subsequent section of said path.

Alternatively, said supporting path may have an angle with the horizontal which is greater at a first section of the path than at a subsequent section of said path.

Said supporting path may be provided with one or more container detecting zones at which size and/or shape is detected by a container detector, said detector communicating with a pattern recognition means to cause any of said exits to selectively open to discharge a container designated for such exit.

Further, means can be provided at a detecting zone for forcibly rotating a container simultaneously with the container being moved by any one of said pusher members.

Said means for forcibly rotating may be endless belt means moved at said detecting zone in a direction opposite that of the direction of movement of said pusher members.

Further, a detecting zone should have a longitudinal length not exceeding $L=\pi \cdot Dmax$, where Dmax is the maximum diameter of any container to be conveyed along said path.

The present device is suitable for multiple empty container types of various types, shapes and materials (e.g. steel, aluminium or plastics). The device provides stability to the containers due to the container being located on said conveying path in a laying state.

The invention is now further to be described with reference to the enclosed drawings showing preferred, non-limitative embodiments of the present invention.

Figure 1:
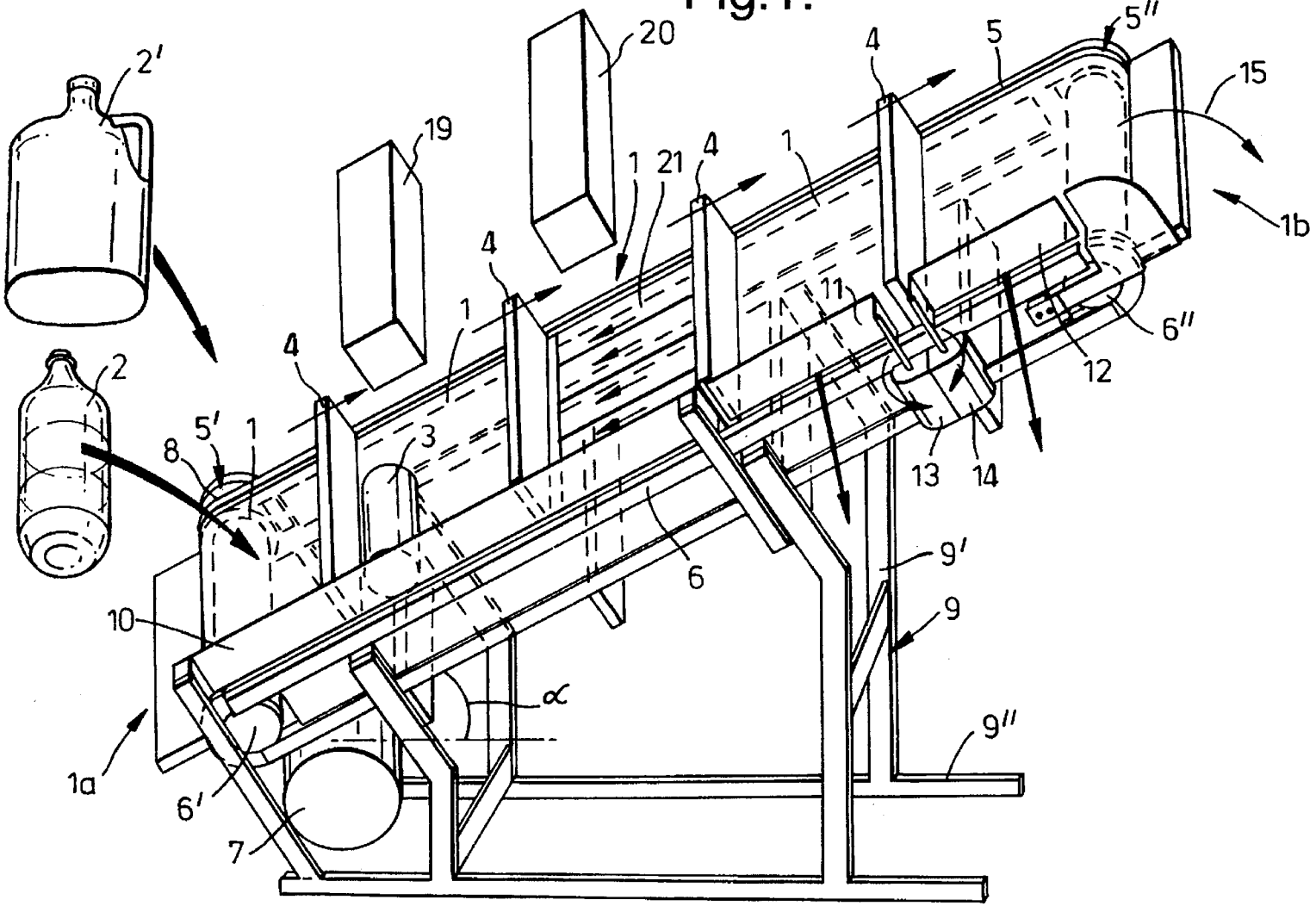
FIG. 1 shows a first embodiment of the present invention.
Figure 2:
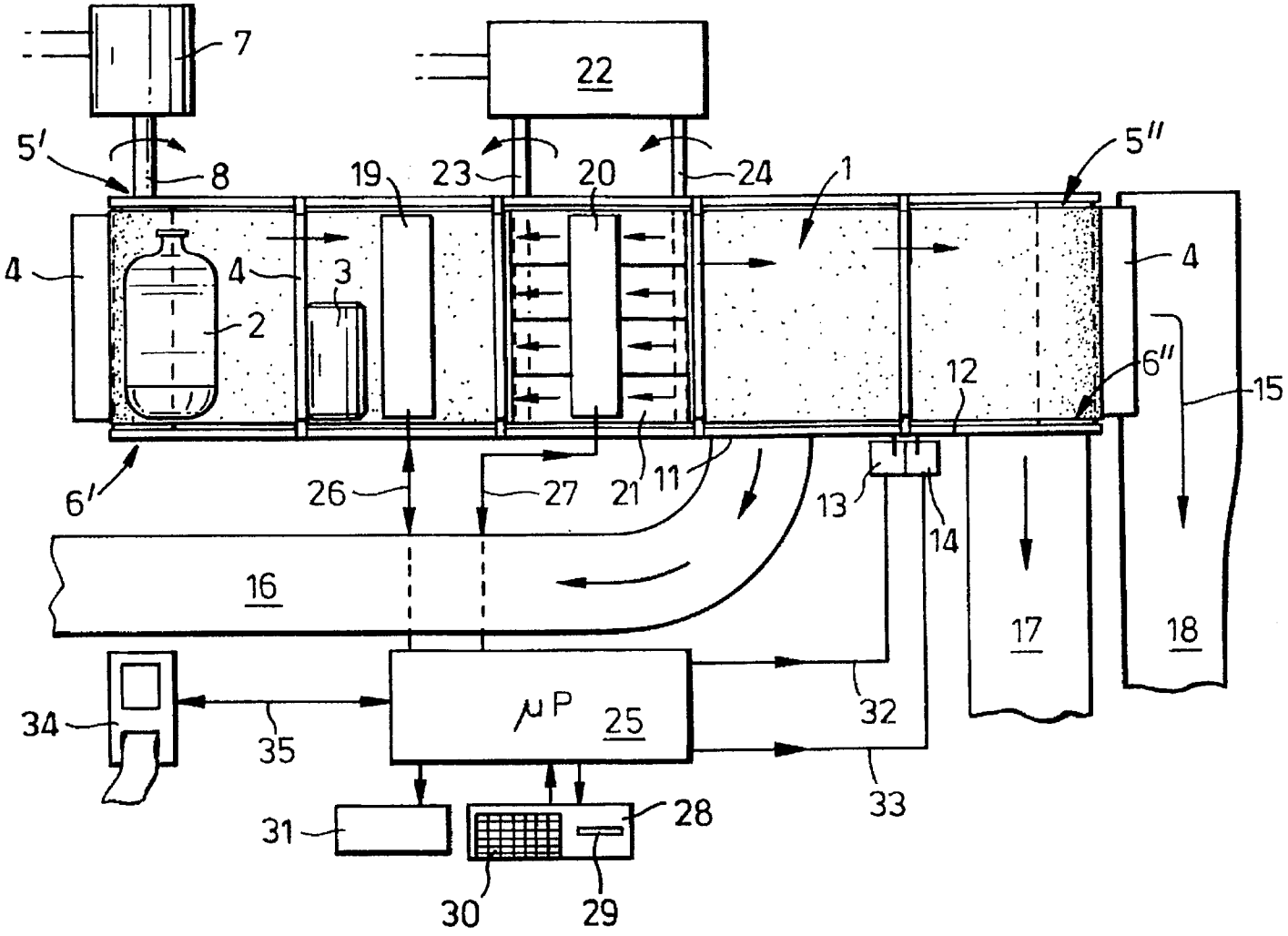
FIG. 2 is a principal drawing of the embodiment in FIG. 1.

In FIGS. 1 and 2, there is shown a stationary, longitudinally extending supporting path 1 having a first end 1*a* at which said empty beverage containers are loaded onto said path, and a second end 1*b* at which said empty beverage containers are discharged from said path if not already discharged from the path at a position intermediate said first and second ends.

In FIGS. 1 and 2, there are shown three typical examples of empty beverage containers, such as a bottle 2, a plastic can 2', and a metallic can 3. The bottle 2 or plastic can 2' could be of glass or plastics, e.g. of the PET type. The said containers 2, 2', and 3 are caused to move along said path 1, e.g. by rolling therealong, by means of pushing means 4. In the example shown in FIG. 4, said pushing means 4 are provided by a plurality of parallel, spaced apart members positioned transversally of said path 1 and having drive means 5 and 6 on either side of said path for moving said spaced apart members 4 along said path 1 by an endless belt. Said drive means 5, 6 are suitably endless toothed belts or chains cooperating with gears 5', 5"; 6',6". Said drive means 5, 6 are mechanically interconnected so as to operate in a common fashion. Said drive means are operated by a motor 7 which connects with said drive means 5, 6 via a transmission 8. It will be noted that the parallel spaced part members 4 suitably are located with the same inter-member spacing and the members 4 are at their respective ends connected to said drive means 5, 6. In the embodiment shown in FIG. 1, it will be noted that the device has a supporting base 9, suitably with uprights 9' and horizontal legs 9" for contacting e.g. a floor.

Figure 8:
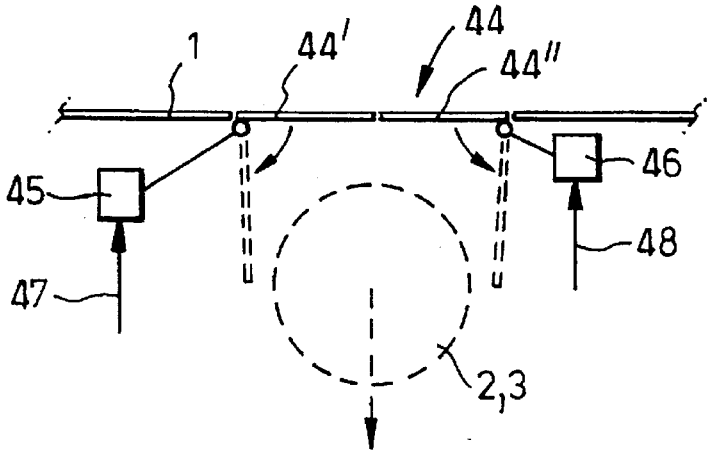
FIG. 8 illustrates schematically a trap door means for operation e.g. with the embodiment shown in FIG. 3 and located in the device supporting path.

The supporting path 1 has, in the embodiment shown in FIG. 1, at least over part of its length a positioning so that it Forms an angle $\alpha$ with the horizontal. Further, said supporting path has bottom supporting means 10 along at least part of its lower, longitudinal edge. It is also clearly seen from FIG. 1 that when viewing the said path 1 transversally, it also in that direction forms an angle with the horizontal. In the specific example shown, there are provided two exit means 11, 12 which actually form an extension of the said bottom supporting means 10. These exit means 11, 12 are, in the example shown, formed as gates, although they could have a different structure, e.g. in the form of trap door means, such as e.g. shown in FIG. 8.

The exit means 11, 12 are, in the example shown operable by control means 13, 14, respectively. Said control means 13, 14 may suitably be of the servo motor or solenoid type. Thus, the exit means 11, 12 will provide for discharging a specific container 2, 2', 3 from the supporting path 1 at specific, related location (gate 11 or 12) along said path 1.

However, if said container is not discharged at either gate 11 or 12, it may be discharged at the very end of the supporting path, as indicated by the arrow 15. Thus, with further reference to FIG. 2, gate 11 provides an outlet to an exit path 16, e.g. a return path for non-acceptable containers. Gate 12 provides an exit to an exit path 17, e.g. for further handling of a container fed onto said exit path 17. Said exit path 17 could e.g. contain a container compactor or some means for collecting the discharged container.

Similarly, the exit at the very end of the supporting path 1 leads the so discharged container, e.g. a bottle 2, a plastic can 2' or a can 3 onto an exit path 18 for further processing or handling as disclosed in connection with the exit path 17.

Positioned over the supporting path 1 are suitably first detector means 19 and second detector means 20. Said first detector means 19 is of type capable of detecting the shape and dimensions of the container when it passes underneath said first detector 19 when pushed by one of the said members 4 of said pushing means.

The second detector 20 may be of a type suitable for detecting e.g. bar code or other characteristic identification features of the container handled. In order to inspect the location of e.g. a bar code or other identification feature located on a container surface, it is preferable to have the container rotated in order to let the detector 20 be able to see said identification feature. In order to provide for forced rotating of the container, there is provided a rotating unit at the specific detecting zone located below said detector 20. Thus, for rotation of the container there is suitably provided a set of parallel, continuous belts 21 driven by a motor means 22, said motor means 22 suitably having a pair of cooperating drive shafts 23, 24. Although two drive shafts are shown, only one drive shaft, e.g. shaft 23 could be sufficient provided that the shaft 24 is replaced by a suitably suspended roller having no mechanical direct connection with said motor means 22.

In order to be able to detect characteristic features of the beverage containers, a micro processor 25 is provided. The detectors 19 and 20 communicate with the microprocessor 25 via suitable signal communication means, e.g. cables 26 and 27, respectively.

In order to let the micro processor be able to process each of the detected containers 2, 2', 3, the micro processor 25 may be provided with an input unit 28 e.g. having a diskette reader 29 and a keyboard 30 and an associated control display 31.

Upon proper detection of a container, the micro processor will control the gates 11 and 12 in order to let one of these gates open to discharge the container in question either to the exit path 16 or exit path 17. The means 13, 14 which cause the gates 11, 12 to open and close, respectively, are controlled from the micro processor 25 via control cables and 33, respectively.

If the micro processor decides not to discharge the container to exit path 16 or 17, then the container is allowed to leave the supporting path 1 at its second end, i.e. leaving at exit 15 to be further conveyed at exit path 18.

In case the present device is to be used in a reverse vending machine for handling empty beverage containers in order to provide a customer with a token of the redemption value of the detected containers, then a control and printer unit may be provided, e.g. as denoted by reference 34 on FIG. 2. The control panel 28 may be used for entering assigned redemption values to various types of empty beverage containers.

The signal line 35 is provided for communication between the control and printer unit 34 and the microprocessor 25.

Figure 3:
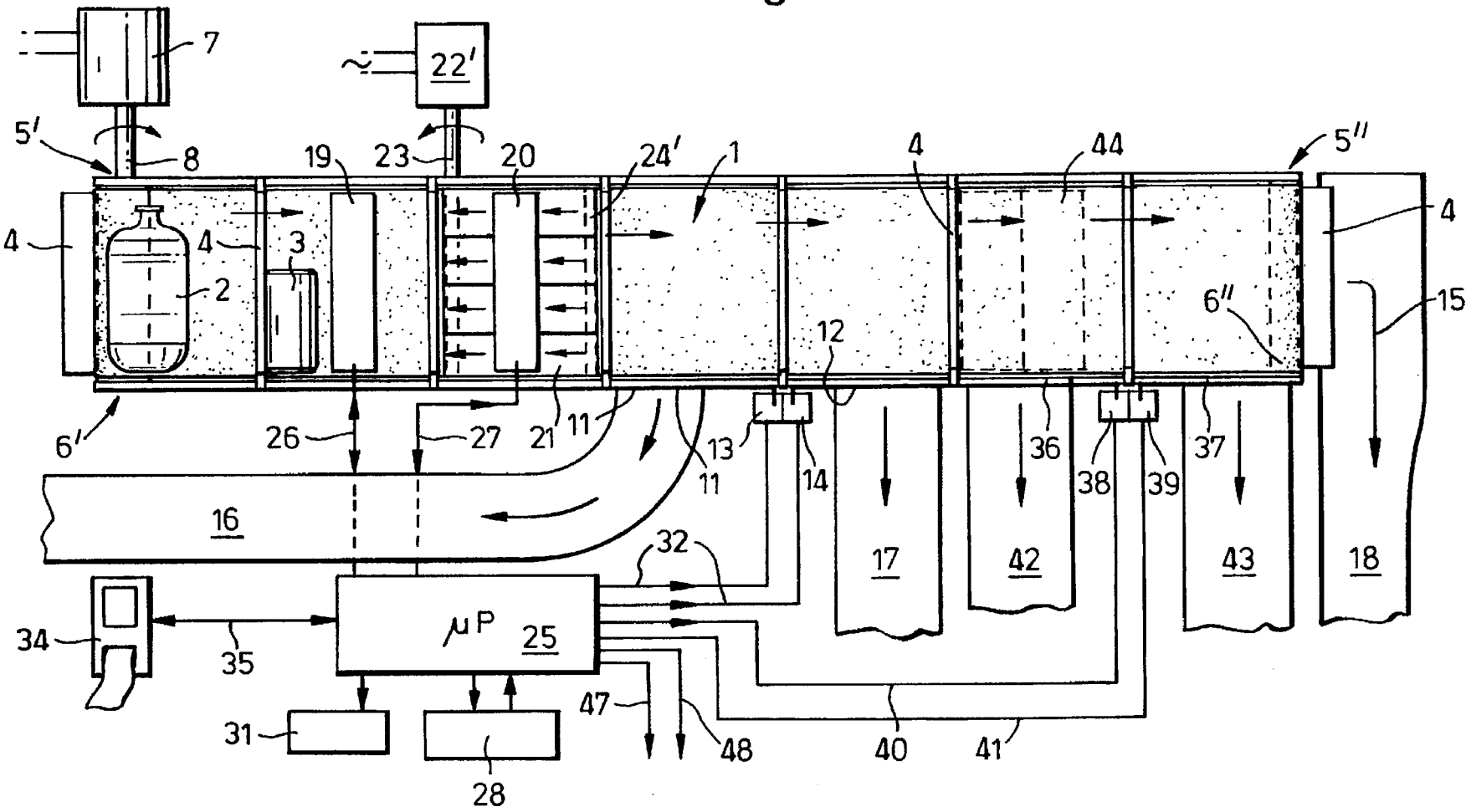
FIG. 3 represents a second, somewhat modified embodiment relative to that shown in FIGS. 1 and 2.

FIG. 3 represents a modification of the embodiment in FIG. 2 (and FIG. 1). Those elements which have already been described in connection with FIGS. 1 and 2 are not further described in connection with the description of FIG. 3.

In FIG. 3, it is clearly seen that the supporting path 1 has two further exits with exit gates 36 and 37 which are operable from the micro processor 25 via gate actuators 38 and 39 through the use of connecting cables 40 and 41, respectively. Gate 36 opens to exit path 42, and gate 37 opens to exit path 43. The exit paths 16, 17, 18, 42 and 43 are suitably based on movement through gravity, although it may envisaged the installation of movable conveyors along any such exit path. If a container does not exit at any path 16, 17, 42 or 43, it will exit at path 18.

As an alternative to the door-like gates 11, 12, 36, 37, one or more of these gates may be replaced by a gate means 44 located in the very surface of the supporting path 1. With further reference to the drawing of FIG. 8, the exit means 44 could be of the trap door type having e.g. a first trap door 44' and a second trap door 44", operable by trap door actuators 45 and 46, respectively. Thus, when the trap doors 44' and 44" operate, a container 2; 3 will fall onto exit path below. In order to control such trap door, control lines 47 and 48 may link the micro processor 25 with said actuators 45 and 46.

Further, in FIG. 3, it is seen that the set of parallel belts 21 move in a direction opposite to the movement of the pushing members 4. The similar situation applies also for the embodiment shown in FIGS. 1 and 2. Further, it is seen that the shaft 24 has been replaced by a roller 24', thus only making use of a single drive shaft 23 operated by modified, single shaft motor 22'.

Figure 4:
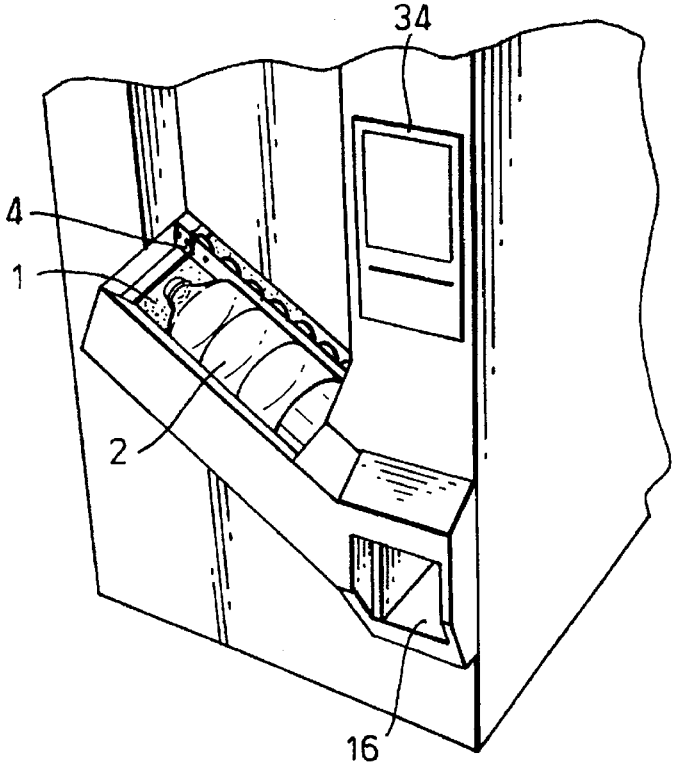
FIG. 4 shows a typical front view of an apparatus containing a device according to the invention.

FIG. 4 illustrates a typical, however non-limitative appearance of a front panel of an apparatus including the device of the present invention. The reference numerals shown in FIG. 4 correspond to the similar elements described and shown in FIGS. 1–3.

Figure 5:
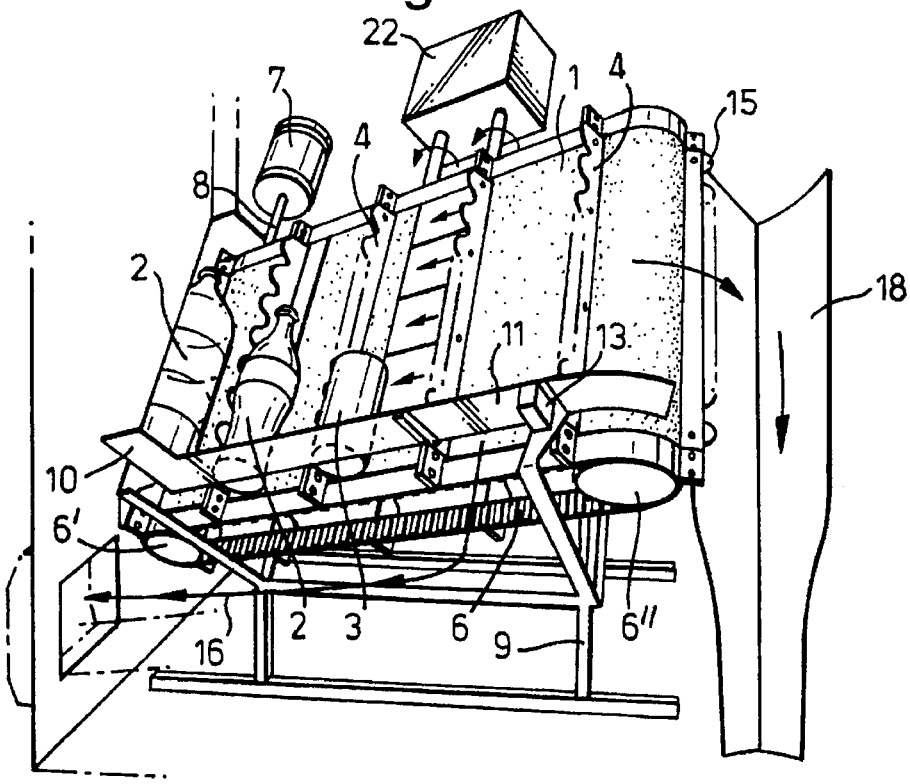
FIG. 5 shows a third embodiment of the device, according to the invention.

FIG. 5 shows the present device in a typical test version having only one exit gate 11 with gate actuator 13. Those containers not being discharged through gate 11 will leave the supporting path 1 at exit 15 to be further conveyed along exit path 18, e.g. through the effect of gravity. It is also seen from FIG. 5 embodiment that the members 4 have a wave like top edge. However, this should not be construed as limiting the scope of the present invention.

The elements labelled in FIG. 5 are found partly in FIGS. 1–3, and their function does therefor not need to be explained any further.

Finally, it will be appreciated that the supporting path 1 may change its inclination, e.g. from a substantially horizontal container entry section 49 to a section 50 at the second far end of the supporting path 1 at which the path 1 is inclined with the horizontal.

Figure 7:
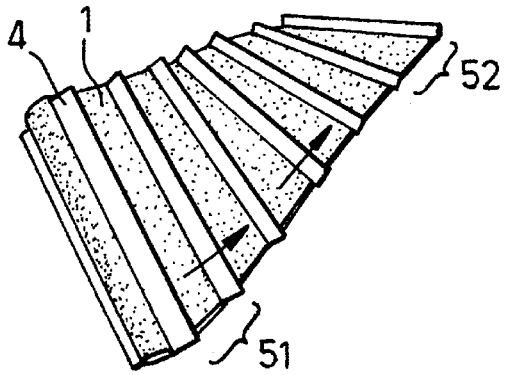

Conversely, as shown in FIG. 7, the supporting path 1 may have a container entry section which is inclined relative to the horizontal, and a second, far end section 52 which is almost horizontal.

Figure 6:
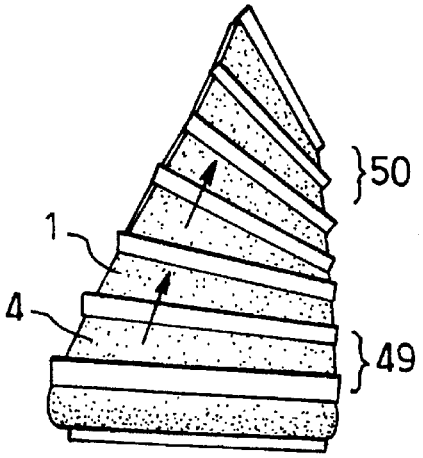
FIGS. 6 and 7 illustrate how the device supporting path can be inclined with the horizontal along the longitudinal distance of the path.

However, it will be appreciated that with reference to FIG. 6, sections 49 and 50 could have any different angle with the horizontal, and similarly, sections 51 and 52 could have any different angles with the horizontal.

Thus, it would be possible with the present invention, through suitable structural modifications of the embodiments shown and described to arrive at the supporting path appearance shown either in FIG. 6 or 7 or any combination of these two variants.

Further modifications of the present device in order to suit particular applications, would lay within the normal activities of an expert in the art. Thus, the present invention is by no means limited to the embodiments shown and described.

Having described our invention, we claim:

1. A device for handling empty beverage containers comprising, a longitudinally extending supporting path having a first end, a second end and a longitudinal edge between said first and second ends, pushing means provided at said supporting path for moving along said supporting path empty beverage containers having a longitudinal axis, said pushing means including a plurality of interlinked, parallel, spaced apart, pushing members positioned to extend transversely of said supporting path to accommodate said containers with their longitudinal axis disposed substantially parallel to said supporting path and substantially parallel to said pushing members, drive means for moving said pushing members along said supporting path, said supporting path in its longitudinal direction and at least over part of its longitudinal length forming a first inclination with the horizontal, said supporting path in its transverse direction and at least over part of a longitudinal distance of said supporting path forming a second inclination with the horizontal, said supporting path having container bottom supporting wall means along at least part of the longitudinal edge of said supporting path, and exit means for discharging a specific container from said supporting path at a specific location along said supporting path, said exit means being selected from at least one of the group of, exit means located in said supporting path, exit means located in said container bottom supporting wall means, and exit means located at the second end of said supporting path.

2. A device according to claim 12 wherein the second inclination of said supporting path in its transverse direction varies along the longitudinal distance of said supporting path.

3. A device according to claim 2 wherein the second inclination of said supporting path in its transverse direction has an angle with the horizontal which is smaller at a first section of the supporting path than at a subsequent section of the supporting path.

4. A device according to claim 2 wherein the second inclination of said supporting path in its transverse direction has an angle with the horizontal which is greater at a first section of the supporting path than at a subsequent section of the supporting path.

5. A device according to claim 1 wherein said supporting path has at least one container detector located in a detection zone that extends above and encompasses a section of the supporting path for detecting identifying features of the container at the detection zone, said detector communicating with a pattern recognition means to cause any of said exit means to selectively open to discharge a container designated for such exit by said pattern recognition means and wherein means are provided at at least one of said detection zones for forcibly rotating a container simultaneously with the container being moved by any one of said pushing members.

6. A device according to claim 5 wherein said means for forcibly rotating a container is an endless belt means moved at said detection zone in a direction opposite to the direction of movement of said pushing members.

7. A device according to claim 5 wherein said detection zone has a longitudinal length along said path not exceeding L=pi● Dmax where Dmax is a maximum diameter of any of said containers conveyed along said supporting path.

* * * * *